United States Patent [19]

Larson

[11] 3,971,319

[45] July 27, 1976

[54] THERMALLY ACTUATED PERCUSSION INITIATABLE EXPLOSIVE CARTRIDGE ASSEMBLY

[75] Inventor: Richard Ralph Larson, Ulster Park, N.Y.

[73] Assignee: Hercules Incorporated, Wilmington, Del.

[22] Filed: Oct. 18, 1974

[21] Appl. No.: 516,232

[52] U.S. Cl. ..... 102/24 R; 102/70 R; 181/116

[51] Int. Cl.[2] ..... F42B 3/10

[58] Field of Search ..... 102/24 R, 27 R, 29, 102/70 R; 181/116

[56] References Cited

UNITED STATES PATENTS

| | | | |
|---|---|---|---|
| 2,487,789 | 11/1948 | Carr et al. | 102/70 |
| 3,509,820 | 5/1970 | Fitch et al. | 102/24 |
| 3,702,589 | 11/1972 | Erbert | 102/70 |

*Primary Examiner*—Verlin R. Pendegrass

[57] ABSTRACT

A percussion initiatable explosive assembly with means for thermal actuation of same, comprising an explosive cartridge shell with main explosive charge contained therein, and a percussion initiatable primer extending into the main charge in detonating relationship therewith; a thermostatic member including a laminate of a pair of metallic layers having different coefficients of thermal expansion shaped as a curved strip having opposed convex and concave surfaces, with the concave surface facing the percussion sensitive portion of the primer; a pin secured to the curved strip and extending from the concave surface into spaced apart relationship with the percussion sensitive portion of the primer; and the strip member in response to a temperature increase adapted to thermally expand to change the curvature of said convex and concave surfaces respectively toward concave and convex so as to move the pin into impact relationship with the percussion sensitive portion of the primer to cause percussion ignition of same, thereby providing for subsequent detonation of said primer base charge and in turn the main explosive charge.

A seismic system containing at least one explosive cartridge above described is also provided.

11 Claims, 6 Drawing Figures

THERMALLY ACTUATED PERCUSSION INITIATABLE EXPLOSIVE CARTRIDGE ASSEMBLY

This invention relates to an explosive cartridge assembly containing a percussion initiatable primer together with a heat responsive percussion initiator means therefor.

Explosive charge assemblies containing percussion initiatable primer means for the main explosive charge have been described in the prior art in connection with off shore seismic exploration. These assemblies include a percussion sensitive ignition charge, i.e., ignitable in response to percussion impact imposed by suitable impact means, and an explosive charge detonatable in operative response to the ignition of the ignition charge — the entire primer assembly being thereby percussion initiatable. In those instances, the charge assembly is delivered to an under water shooting area for percussion initiation under its own momentum, or by action of an air operated mechanism for receiving the moving charge and then regulating its travel with percussion impact of the primer with an air driven pin member. In all instances, the percussion initiation is dependent upon travel of the cartridge assembly to the shooting area with immediate impact for the subsequent percussion initiation.

This invention is concerned with explosive cartridge assemblies including a percussion initiatable primer which can be emplaced in a shooting area and fired at any suitable time thereafter, and which is particularly applied to land seismic use.

In accordance with the invention, an explosive cartridge assembly is provided which comprises a shell, and at least a portion of same enclosed and containing a main explosive charge;

a percussion initiatable primer extending into said enclosed shell portion and into said main charge therein, said primer including a percussion sensitive ignition charge adjacent an external wall of said enclosed shell portion, and a base explosive charge detonatable in operative response to ignition of said ignition charge and disposed in detonating relationship with said main charge;

thermostatic means outside said enclosed shell portion for percussion initiation of said primer including a laminate of a pair of metallic layers having different coefficients of thermal expansion, and said laminate being a curved strip having opposed convex and concave surfaces;

said strip spaced from said percussion sensitive ignition charge, and supported at its opposite ends with said concave surface facing said ignition charge, and a pin member secured to said strip and extending from said concave surface toward said ignition charge into spaced apart relationship with said ignition charge for subsequent percussion impact therewith;

said strip in response to a predetermined increase in temperature thereof adapted to expansively change the curvature of said convex and concave surfaces respectively toward concave and convex so as to move said pin into said impact relationship and cause percussion ignition of said ignition charge, thereby providing for subsequent detonation of said primer base charge and in turn said main explosive charge.

In a preferred embodiment, the cartridge shell is elongated and includes an end wall closure member intermediate its ends to divide the shell into an enclosed shell portion, and an adjacent recessed shell end portion in direct and open communication with the outside of the shell, and within which the thermostatic means is supported. The intermediately disposed end wall closure member contains a passageway extending substantially coaxially therethrough, and a tubular well member extends, closed end first, through, and supported in, the passageway in water tight relationship therewith and into the main explosive charge for support of the primer device for the percussion initiation and subsequent detonation.

The primer device comprises, in preferred practice, a closed elongated shell including an empty primed rifle cartridge casing as an end closure member. However, the primer shell can be closed in any suitable manner with the percussion sensitive ignition charge supported in confinement on the inner end closure wall. At least one explosive charge is contained in the primer shell and is disposed to detonate in operative response to percussion ignition of the ignition charge. Generally, the primer shell contains a base explosive charge spaced from the ignition charge, and a primer charge intermediate the explosive and ignition charges detonatable in response to ignition of the ignition charge and in detonating relationship with the base charge. The primer device is inserted into the well, explosive charge end first, to leave the percussion sensitive ignition end outside the tubular well member, preferably outwardly flanged so as to seat the ignition charge on the open end of the primer well.

The thermostatic percussion initiator means in preferred practice is secured at its opposite ends to a support member extending across the open end of the shell recess, the support member often containing one or more perforations for admitting fluid at the predetermined high temperature into contact with the strip member for causing it to change curvature for moving the pin into percussion impact with the percussion sensitive ignition charge.

Exemplary laminate strips are those in which the metallic layer having the higher thermal coefficient of expansion is such as copper/brass (60% copper, 40% zinc), and iron-nickel alloys to which may be added chromium, for example an alloy containing 22% nickel, 3% chromium and 75% iron; and the metallic layer having the lower coefficient of expansion is such as an iron-nickel alloy containing between 35 and 50% nickel such as Invar (36% nickel, 64% iron), and a chromium aluminum iron alloy containing 70% chromium, 4% aluminum and the balance iron.

The invention is illustrated with reference to the drawings of which

Figure 1:
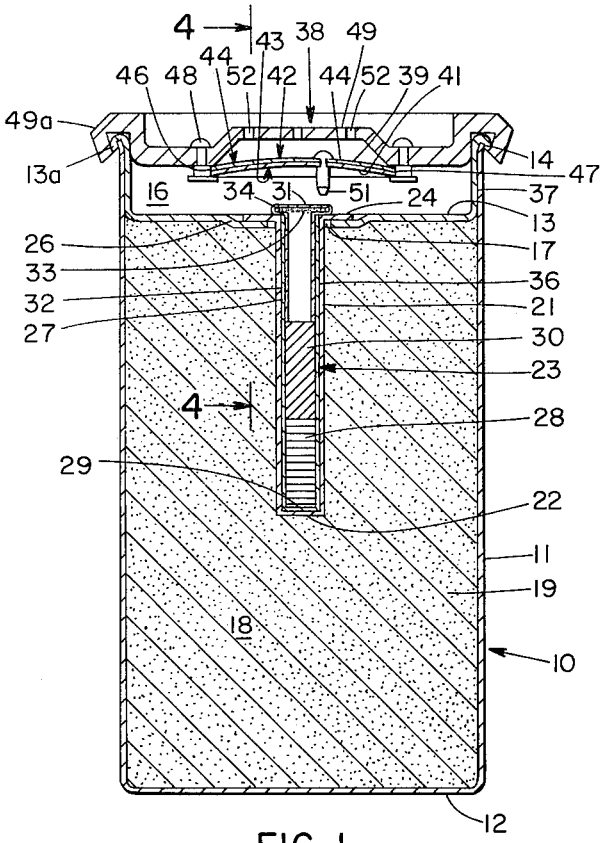
FIG. 1 shows in cross section an explosive cartridge of the invention in which the percussion initiation is provided by a thermostatically actuated pin means in combination with a rim fired empty primed rifle cartridge casing as an end closure for the primer.

Referring to FIG. 1, explosive cartridge assembly 10 comprises elongated shell 11 closed at bottom end 12 and by opposite wall closure member 13 spaced from open top shell end 14 to form a resulting top open recessed shell end portion 16.

End wall closure of cartridge 10 contains central passageway 17 extending therethrough to directly communicate recess 16 with the enclosed shell portion 18 containing main explosive charge 19.

Well member 21 extends closed end 22 first through opening 17 into operative contact with explosive charge 19 to support a primer device 23 in detonating relationship therewith; and is supported at its open end in wall 13 in any suitable manner, generally by extension of its open end into peripheral lip 24, and with lip 24 seated on the exterior surface of wall closure 13 immediately adjacent opening 17, often within a recessed portion 26 of wall 13.

Primer device 23 includes shell 27 containing a high explosive base charge 28 such as PETN, adjacent closed end 29, and primer charge 30 superposed on charge 28 and spaced from ignition charge 33. Shell 27 is closed at its top end by end closure 31. In the embodiment shown, closure 31 is the percussion sensitive end of an empty rim fired primed cartridge casing 32. Thus, ignition charge 33 is peripherally supported in confinement in cavity 34 of closure 31 on inner wall 33 of closure 31, consonant with standard rifle cartridge casing design.

Percussion sensitive charge 33 is any suitable ignition composition adjacent the external wall of the enclosed cartridge shell portion which ignites to produce a flame in response to compression resulting from force of percussion applied to the exterior surface of closure 31. In the embodiment shown, the above described empty rim fired primed rifle cartridge casing 32 is inserted open end first into the top open end of shell 27. The lower shell casing portion 36 is of outside diameter sufficiently less than the inside diameter of shell 27 to provide for an interference or friction fit for the water tight closure.

Primer 23 is disposed entirely within well member 21 except to dispose the percussion sensitive charge 33 in cavity 34 at least flush with the exterior surface of the open end of well 21; and preferably to permit the entire charge 33 and cavity portion 34 containing same to extend from the well member into recess 16 and seated on the lipped top end 24 of well member 21 to facilitate application of percussion force to the exterior of the cavity 34 for compression and ignition of ignition charge 33.

When utilizing an empty primed rim — or center-fired (FIG. 2) rifle cartridge casing as a closure member, the rifle casing can be of any desired length such as in the order of about ⅜ inch; and from about 0.3 to 0.4 grain of the ignition charge is advantageously utilized.

Base charge 28 and primer charge 30 superposed thereon and spaced from ignition charge 33 are advantageously those utilized as such in the blasting cap art, for example base high explosive charges such as PETN, pentolite, cyclonite, tetryl and the like; and primer charges such as diazodinitrophenol, lead azide, and mercury fulminate.

Percussion sensitive ignition charge components include lead styphnate, mercury fulminate, antimony sulfide and lead azide and mixtures of such materials as are well known in the munitions art, and are preferably those utilized as the "primer" charge in 0.22 caliber rifle cartridges.

Although not shown, a suitable delay fuse such as used in the blasting cap art, as for example, barium peroxide/tellurium, barium peroxide/selenium and the like, can be emplaced intermediate the primer 30 and ignition 33 charges to afford any desired delay between ignition and the main charge detonation.

Wall closure 13 is supported in any suitable manner such as by extension of same upwardly along the top inner end wall section 37 of shell 11 into closing relationship with shell 11 and having its peripheral endmost portion forming crimp **13*a* over the top end 14 of shell 11**.

Thermostatic initiator means 38 comprises a lamination of metallic layers 39 and 41 having different coefficients of thermal expansion and joined, as by brazing, as curved laminate strip 44 having opposed convex 42 and concave 43 surfaces spaced from, and encompassing, well 21, with concave surface 43 facing the percussion sensitive ignition charge 33 in the primer 23. Metallic layer 41 has a coefficient of thermal expansion higher than that of metallic layer 39. Further exemplary of laminate strip 44 is a copper/brass (60% copper, 40% zinc) layer 41 joined by braze with a chromium/aluminum/iron (70% chromium, 4% aluminum, 26% iron) layer 39.

Laminate strip 44 is supported at its opposite ends 46 and 47 by suitable means such as rivets 48 to cover member 49, the latter closing recess 16 above strip 44, and secured to the end 14 of shell 11 by suitable means such as by crimp of its peripheral portion **49*a* over crimp portion 13*a* of closure 13. Pin 51 is secured to strip 44, such as by a snap action shown, and extends toward percussion sensitive end 31 and primer charge 33 therein, and into spaced apart relationship with primer 23. Perforations 52 in cover 49 openly communicate strip member 44 with the exterior of the cartridge assembly 10**.

In most embodiments, the pin member most advantageously extends substantially coaxially with the primer. However, in the embodiment of FIG. 1, in which the empty primed rifle cartridge casing is rim fired, the pin member 51 advantageously extends off center toward primer 23 in order to afford maximum force of compression of charge 33 from the impact of pin 51 therewith, as further illustrated with reference to FIG. 4.

Figure 6:
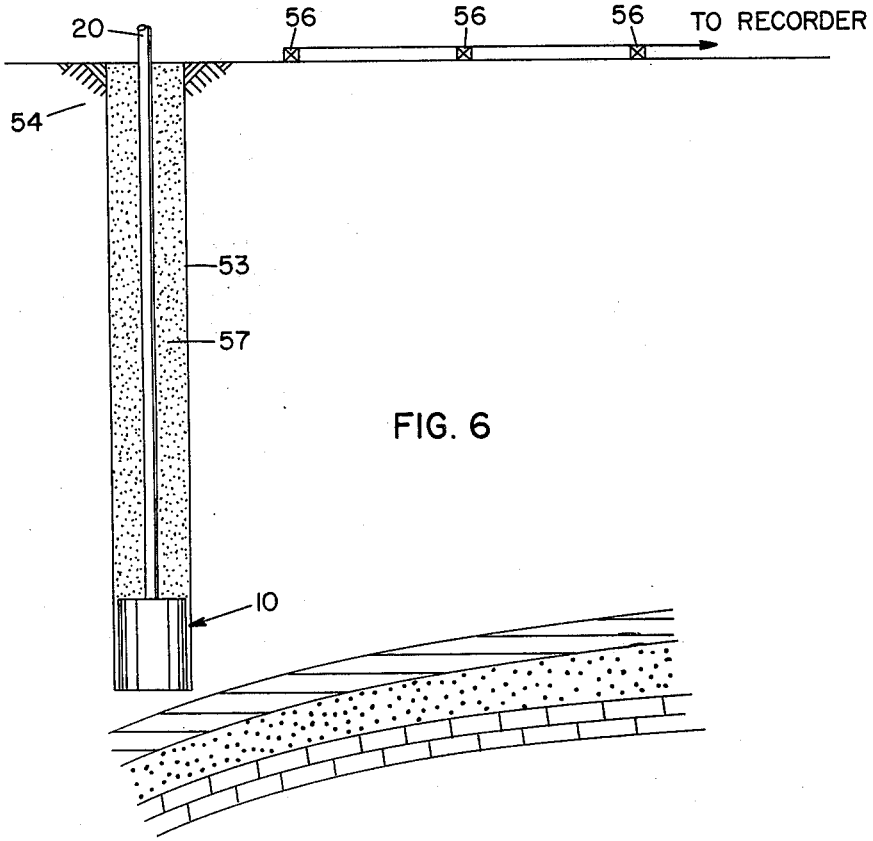
FIG. 6 illustrates the emplacement and firing of a cartridge assembly of the invention in an on-land seismic system. All like parts of the drawings are like numbered.

The cartridge assembly of FIG. 1 is particularly advantageously applied to on-land seismic exploration of which one embodiment is illustrated with reference to FIG. 6. Referring to FIG. 6, a cartridge assembly 10 of FIG. 1 is emplaced in a bore hole 53 in earth formation 54, by securing the cartridge to a hot fluid-delivery conduit 20 for connection with a hot fluid supply not shown, and then lowering the cartridge-delivery conduit into the bore hole with subsequent stemming by suitable stemming material 57.

Generally, the fluid-delivery conduit is taped to explosive cartridge 10 so as to open into direct communication with cover 49 for passage of the hot fluid through openings 52 into direct heat exchange contact with strip 44 thereby causing strip 44 to move toward primer charge 33 for the initiation.

Geophones 56 are positioned on the ground at predetermined distances from the explosive assembly for receiving shock waves from refraction and reflection in the underground structure following the shot, and for transmission to the seismic energy measuring system for the seismic record.

A stream of steam, or other suitable fluid such as hot air, is passed from a source not shown via conduit 20 into the bore hole 53 and into direct contact with cover 49 of the assembly and through perforations 52 into heat exchange with the cooler convex and concave surfaces 42 and 43 of strip 42. In response to heat transfer from the hot fluid, strip 44 undergoes thermal expansion toward primer well 21 and primer 23 and hence toward percussion sensitive ignition charge 33. As the thermal expansion continues in that direction, the strip passes through a position of 180° and at that point it contains an accumulation of kinetic energy which, after travel of the strip beyond the 180° position, acts to impart a marked increase in the rate of travel to provide a "snap-action" movement toward the percussion sensitive ignition charge to forceably move pin 51 into impact contact with the ignition charge with sufficient force to cause percussion initiation of charge 33. Primer charge 30 is detonated in response to action of heat and flame generated by ignition of charge 33, and base charge 28 responsively detonates, in turn causing detonation of main explosive charge 19, the seismic energy thus generated being transferred to suitable seismic energy measuring means not shown.

Although water, steam or hot air are preferred fluids for effecting the requisite temperature increase for actuation of strip 44 and pin 51 for the percussion initiation, any suitable fluid can be utilized.

Figure 4:
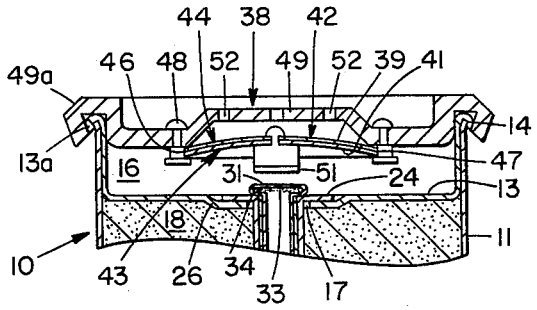
FIG. 4 is a view along the line 4—4 of FIG. 1 further illustrating the pin assembly for the rim firing.

In the embodiment of FIG. 1, the cartridge casing 32 is rim fired, and hence pin 51 is supported sufficiently off center from strip 44 to directly impact the rim charge 33 when strip 44 is moved in response to the requisite temperature increase, as further illustrated with reference to FIG. 4.

Figure 2:
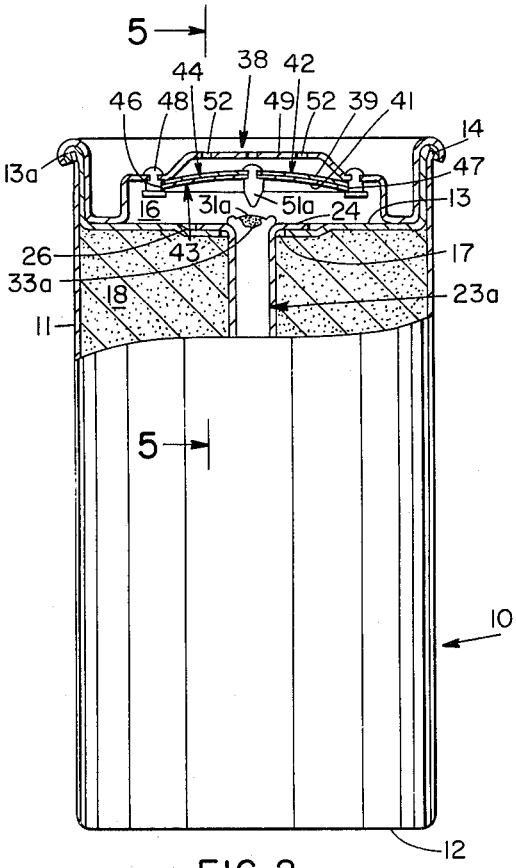
FIG. 2 is the same as FIG. 1 except that the pin means and empty primed rifle cartridge casing members are adapted for center firing.
Figure 5:
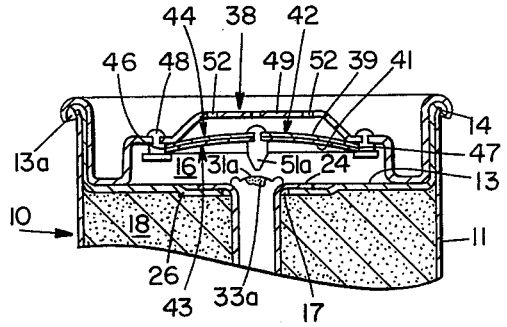
FIG. 5 is a view taken along the line 5—5 of FIG. 2 further illustrating the pin assembly of FIG. 2 for center firing.

The embodiment of FIG. 2 differs from that of FIG. 1 only in respect of the closure 31*a* which is of the center fired type in lieu of closure 31 of the rim fired cartridge casing of FIG. 1. Accordingly, pin 51*a* for center firing, also as shown by FIG. 5 is advantageously supported so as to extend from curved strip 44 substantially coaxially with primer 23 in order to be in preferred position for the requisite percussion impact of pin 51*a* with center charge 33*a*.

Figure 3:
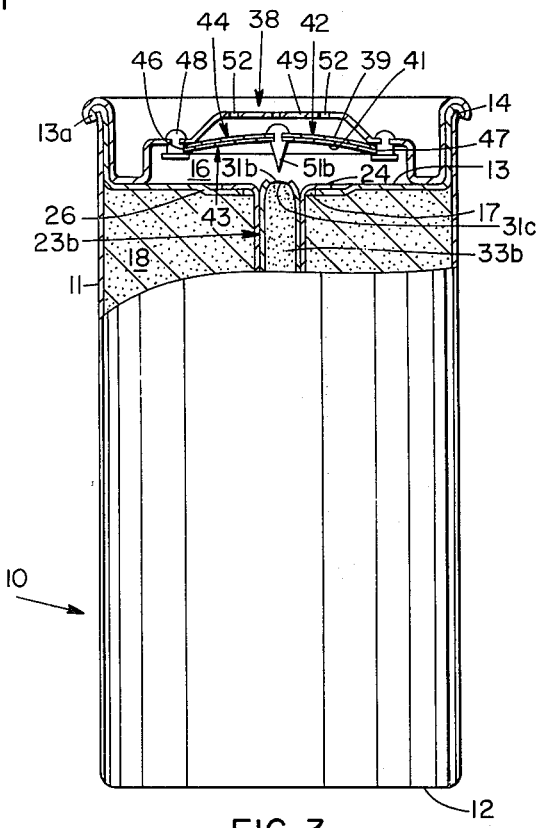
FIG. 3 is the same as FIG. 1 except that the primer end closure is a thin wall member and the pin member is adapted in combination therewith for stab firing the ignition charge for the initiation.

The embodiment of FIG. 3 is the same as that of FIG. 1 except that the ignition system is of the "stab fire" type and hence the pin member 51*b* is pointed at its end adjacent to the primer 23*b* for piercing the upper primer end wall 31*b* for direct percussion impact with the ignition charge 33*b*. As shown, end wall 31*a* having a thickness less than that of the remainder of shell 27 and often formed from a layer of metal foil 31*c*, is readily pierced for the percussion initiation of charge 33*b* which substantially fills an end section of the primer shell adjacent the external wall 13 of shell 11 so as to be in position for the impact ignition.

The operation of the embodiments of FIGS. 2 and 3 is the same as that illustrated with reference to FIG. 1 except for the use of the center fire system of FIG. 2 and the stab fire system of FIG. 3.

The percussion sensitive ignition charge of the rim-, or center-fired primer assembly component is more often supported spaced apart from the interior of the enclosed cartridge shell portion at least flush with the open end of the primer well; and in all events it is positioned adjacent the above described exterior wall of the enclosed cartridge shell portion, by which it is meant flush with said exterior wall, or in close proximity to either side thereof. Similarly, in a stab-fire ignition system the ignition charge extends into the interior of the primer shell from a plane about flush with the above described exterior shell wall or in close proximity to either side thereof, and hence it is in all events positioned adjacent said exterior shell wall.

The main explosive charge 19, is generally a cap insensitive charge often of the NCN type, although cap sensitive charges 19 can be utilized.

What I claim and desire to protect by Letters Patent is:

1. An explosive cartridge assembly which comprises a shell, and at least a portion of same enclosed and containing a main explosive charge;

a percussion initiatable primer extending into said shell and into said main charge therein, said primer including a percussion sensitive ignition charge adjacent an external wall of said enclosed shell portion and a base explosive charge detonatable in operative response to ignition of said ignition charge and disposed in detonating relationship with said main charge;

thermostatic means outside said enclosed shell portion for percussion initiation of said primer including a laminate of a pair of metallic layers having different coefficients of thermal expansion, and said laminate being a curved strip having opposed convex and concave surfaces;

said strip spaced from said percussion sensitive ignition charge and supported at its opposite ends with said concave surface facing said percussion sensitive ignition charge, and a pin member secured to said strip and extending from said concave surface toward said ignition charge into spaced apart relationship with said ignition charge for subsequent percussion impact therewith;

said strip in response to a predetermined increase in temperature thereof adapted to expansively change the curvature of said convex and concave surfaces respectively toward concave and convex so as to move said pin into said percussion impact and cause percussion ignition of said ignition charge, thereby providing for subsequent detonation of said primer charge and in turn said main explosive charge; and means for admitting flow of sufficiently hot fluid into contact with said laminate strip for transfer of heat from said fluid to said laminate strip to cause said strip to change its curvature to move said pin member into said percussion impact, to thereby initiate said primer for detonation of said main explosive charge.

2. An explosive cartridge assembly of claim 1 wherein said primer comprises an elongated closed shell containing said ignition and base explosive charges, and said ignition charge is supported on an inner end wall closure of said primer shell.

3. An explosive cartridge assembly of claim 2 wherein said primer shell is closed at one end by an empty primed rifle cartridge casing, and the percussion sensitive ignition charge of said rifle cartridge casing constitutes said primer ignition charge.

4. An explosive assembly of claim 3 wherein said empty primed rifle cartridge casing is center fired.

5. An explosive cartridge assembly of claim 3 wherein said empty primed rifle cartridge casing is rim fired.

6. An explosive cartridge assembly of claim 1 wherein said primer comprises an elongated closed shell containing said ignition and base explosive charges, and said percussion sensitive ignition charge substantially fills an end section thereof adjacent said external wall of said enclosed shell portion, and the end wall of said primer shell end section adapted to receive said pin member in penetrating relationship therewith so as to permit said pin to stab said ignition charge in response to said percussion impact and responsively cause ignition of said ignition charge.

7. An explosive cartridge assembly comprising an elongated cartridge shell closed at one end, and a wall member intermediate the ends of said cartridge shell transversely closing same to form an enclosed cartridge shell portion and an adjacent recessed shell portion in open communication with the outside of said shell;

a percussion initiatable primer assembly comprising a closed elongated shell including an empty primed rifle cartridge casing extending open end first substantially coaxially into said primer shell as an end closure therefor, and a base explosive charge in the opposite end of said primer shell operatively detonatable in response to ignition of the ignition charge in said casing;

said wall member containing a passageway extending therethrough substantially coaxially with said cartridge shell, and a tubular member closed at one end and extending closed end first through said passageway into said main charge;

said percussion initiatable primer extending base charge end first into said tubular member as a support well for said primer and having its percussion sensitive end seated on the open end of said tubular member adjacent said wall member, and said base explosive charge in detonating relationship with said main explosive charge;

thermostatic means within said recessed shell portion for percussion initiation of said primer including a laminate of a pair of metallic layers having different coefficients of thermal expansion, and said laminate shaped as a curved strip having opposed convex and concave surfaces;

said strip spaced from said percussion sensitive ignition charge with said concave surface facing said ignition charge, and a pin member secured to said strip and extending from said concave surface toward said ignition charge into spaced apart relationship with said ignition charge for subsequent percussion impact;

said laminate strip in response to a predetermined increase in temperature thereof adapted to expansively change the curvature of said convex and concave surfaces respectively toward concave and convex so as to move said pin into said percussion impact and cause percussion ignition of said ignition charge, thereby providing for subsequent detonation of said base explosive charge and in turn said main explosive charge; and a support member for said laminate strip within said recess and including a central section encompassing said laminate strip, said strip supported at its opposite ends on said support member, and perforation means in said central section for admitting flow of sufficiently hot fluid into contact with said laminate strip for transfer of heat from said fluid to said laminate strip to cause said strip to change its curvature to move said pin member into said percussion impact.

8. In an explosive assembly of claim 7, said support means transversely closing, and secured at its periphery to the wall of, said recessed shell portion.

9. A seismic exploration system including an explosive charge assembly of claim 1 disposed in a bore hole for detonation to generate seismic energy for a seismic record;

conduit means extending into said bore hole and into operative relationship therein with said cartridge assembly for delivery of sufficiently hot fluid for said contact with said laminate strip and said transfer of heat, to thereby initiate said primer for detonation of said main charge for producing said seismic energy;

and means for measuring said seismic energy for said seismic record.

10. An explosive assembly of claim 8 wherein said support member is crimped about its periphery to the open recessed end of said cartridge shell.

11. In an explosive cartridge of claim 3, support means for said laminate strip disposed outside the enclosed portion of said cartridge shell and secured to opposing ends of said laminate strip and to said cartridge shell and including a central section spaced from, and covering, said laminate strip, and perforation means in said central section for admitting said flow of fluid into contact with said laminate strip.

* * * * *